US005962799A

United States Patent [19]

Hsieh

[11] Patent Number: 5,962,799

[45] Date of Patent: Oct. 5, 1999

[54] DEVICE FOR SECURING A DRUMSTICK OF A DRUM

[76] Inventor: Wu-Hong Hsieh, No. 46, Lane 59, Chungcheng Rd., Luchou Hsieng, Taipei Hsien, Taiwan

[21] Appl. No.: 08/901,047

[22] Filed: Jul. 28, 1997

[51] Int. Cl.[6] ..... G10D 13/02

[52] U.S. Cl. ..... 84/422.1

[58] Field of Search ..... 84/422.1

[56] References Cited

U.S. PATENT DOCUMENTS 5,343,792 9/1994 Liao ..... 84/422.1

*Primary Examiner*—William M. Shoop, Jr.
*Assistant Examiner*—Shih-yung Hsieh
*Attorney, Agent, or Firm*—Hedman, Gibson & Constigan, P.C.

[57] ABSTRACT

A device which can securely locate and easily adjust an angle of a drumstick of a drum is disclosed The device comprises a pedestal mounted on a pivot of the drum and a rotator engaged with the pedestal. The pedestal has a protrusion formed on a surface thereof. The rotator defines a plurality of recesses at a bottom thereof to respectively receive the protrusion of the pedestal according to requirements. In a preferred embodiment of the present invention, the rotator isometrically defines three recesses respectively corresponding to a rubber part, a wood part and a blanketing part of the drumstick.

4 Claims, 5 Drawing Sheets

B-B

A-A

DEVICE FOR SECURING A DRUMSTICK OF A DRUM

BACKGROUND OF THE INVENTION

1. Field of the Invention

The present invention relates to a device for securing a drumstick, and more particularly to a device which can securely locate and easily adjust an angle of the drumstick.

2. Description of Related Art

Drums have been popular musical instruments for thousands of years all over the world, and the bass drum has become particularly popular in modern music. In performance, the drum generally has a drumstick frame 50, as shown in FIG. 6. The drumstick frame 50 includes two side rods (not numbered), each having a sleeve 51 mounted to a respective end thereof. A pivot 52 is connected between the two sleeves 51. One end of the pivot 52 extends outwardly from one of sleeves 51 and is connected with a spring 53 provided for reset control of a drumstick 60. A device for securing the drumstick 60 is mounted on the pivot 52 and connected to a pedal of the drum. The securing device is composed of a pedestal 55 and a rotator 57. The drumstick 60 includes a stem 61 extending through the pedestal 55 and the rotator 57. A first bolt 56 and a second bolt 58 are respectively screwed into the pedestal 55 and the rotator 57 to retain the stem 61. Therefore, a user can operate the drumstick 60 by trampling the pedal. Also, to obtain various sound effect, a head (not numbered) of the drumstick 60 are divided into several parts wrapped by different materials, such as rubber, blanket and wood. The adjustment of the head is accomplished by releasing the bolts 56, 58 and rotating the drumstick 60 to a desired position.

The above mentioned securing device and adjustment manner all have disadvantages. When the drum is operated for a long period of time, the bolts 56, 58 may become loose, thus the drumstick 60 may shift and cause the head to generate disharmony sound due to the beat of different parts. Moreover, the adjustment of the drumstick 60 is accomplished depending on the sight of a user, therefore, error may occur during the adjustment.

The present invention provides an improved device for securing a drumstick to mitigate and/or obviate the aforementioned problems.

SUMMARY OF THE INVENTION

One object of the present invention is to provide a device which can securely locate and easily adjust a drumstick.

In accordance with one aspect of the present invention, the device for securing the drumstick comprises a pedestal mounted on a pivot of the drum and a rotator engaged with the pedestal. The pedestal has a protrusion formed on a surface thereof. The rotator defines a plurality of recesses at a bottom thereof to respectively receive the protrusion of the pedestal by rotating the rotator according to requirements.

In accordance with another aspect of the present invention, the rotator isometrically defines three recesses at the bottom thereof, respectively corresponding to three materials wrapping the drumstick.

In accordance with a further aspect of the present invention, the pedestal and the rotator respectively defines a first through hole and a second through hole aligned with each other for a stem of the drumstick to extending therethrough. The pedestal and the rotator further defines a first screw hole and a second screw hole respectively in which two bolts are threaded to retain the stem of the drumstick.

Other objects, advantages and novel features of the invention will become more apparent from the following detailed description when taken in conjunction with the accompanying drawings.

DETAILED DESCRIPTION OF PREFERRED EMBODIMENT

Figure 1:
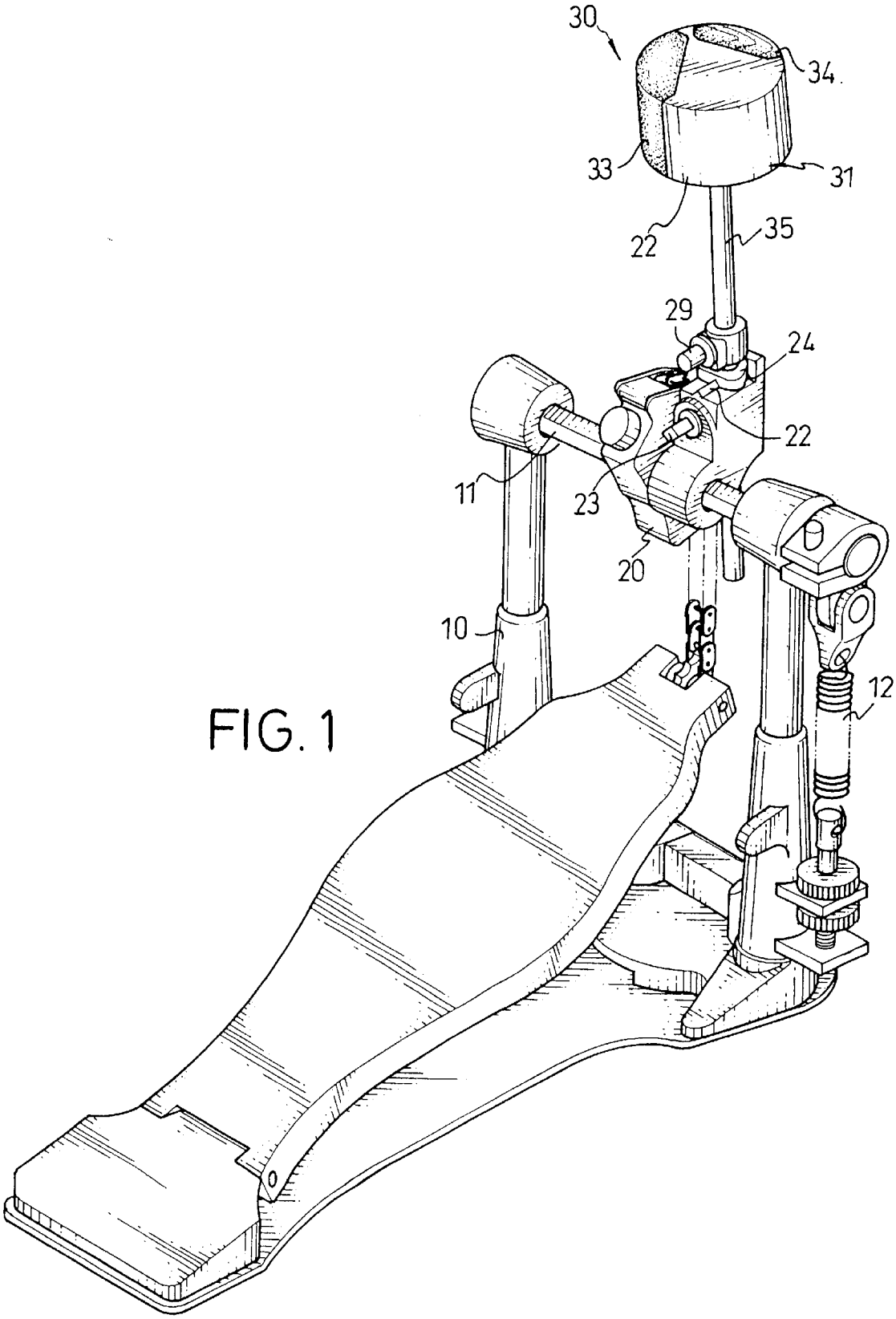
FIG. 1 is a perspective view showing a drumstick frame of a drum in accordance with the present invention.

Referring to FIG. 1, a drumstick frame 10 of a drum in accordance with the present invention generally includes two side rods (not numbered) respectively disposed at two sides of a drum pedal (not numbered) and a pivot 11 connected between the two side rods, wherein one end of the pivot 11 extends outwardly from one of the side rods and is connected with a spring 12 provided for reset control of a drumstick 30. A device for securing the drumstick 30 is mounted on the pivot 11 and connected to the pedal of the drum. The securing device is composed of a pedestal 20 and a rotator 24. The drumstick 30 includes a stem 35 extending through the pedestal 20 and the rotator 24, and a head 31 divided into several parts wrapped by different materials, such as a rubber part 32, a blanketing part 33 and a wood part 34. With this head 31 of the drumstick 30, different sound effect can be generated during performance.

Figure 2:
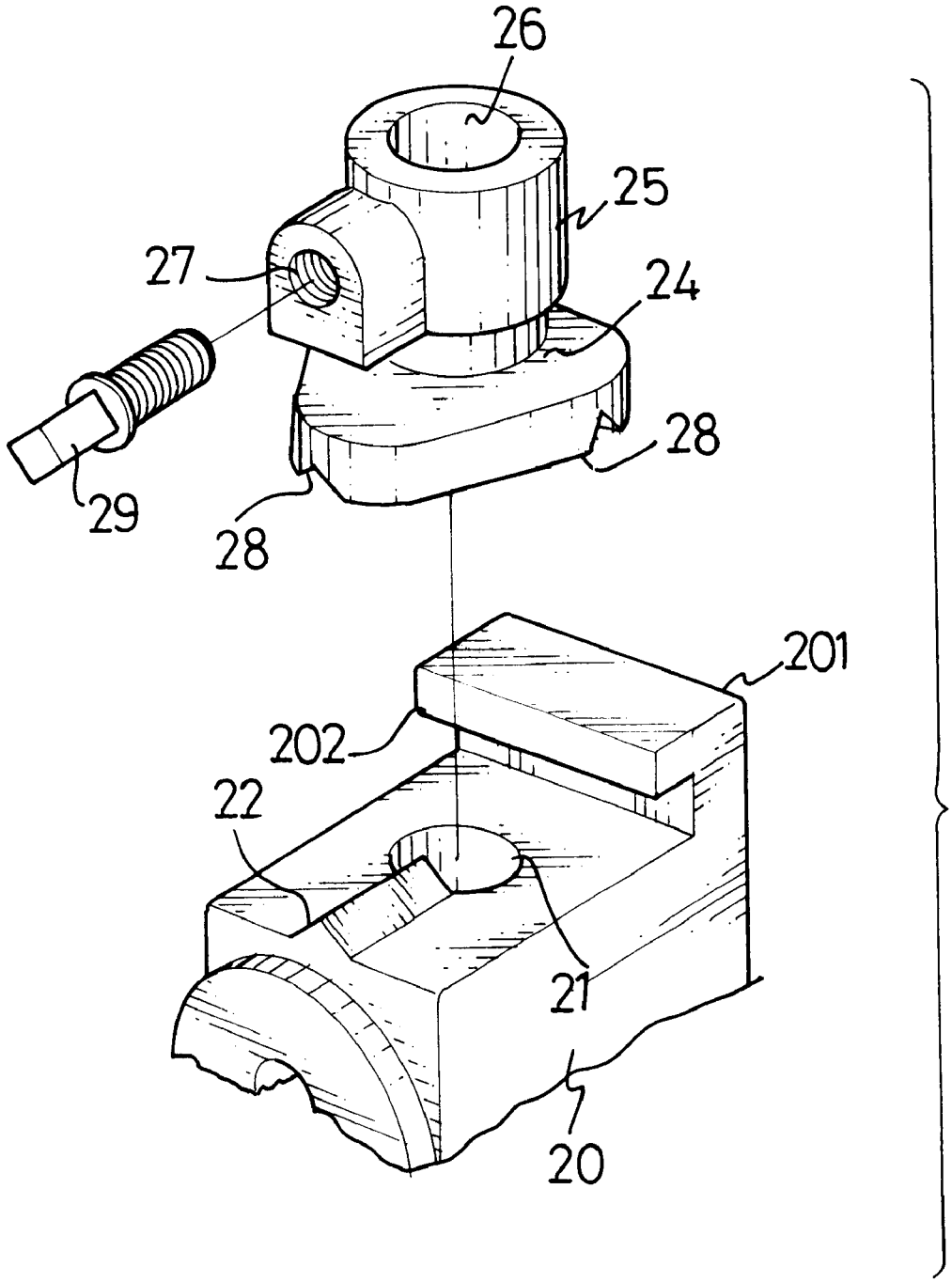
FIG. 2 is a partial exploded view showing a device for securing the drumstick of FIG. 1.
Figure 3:
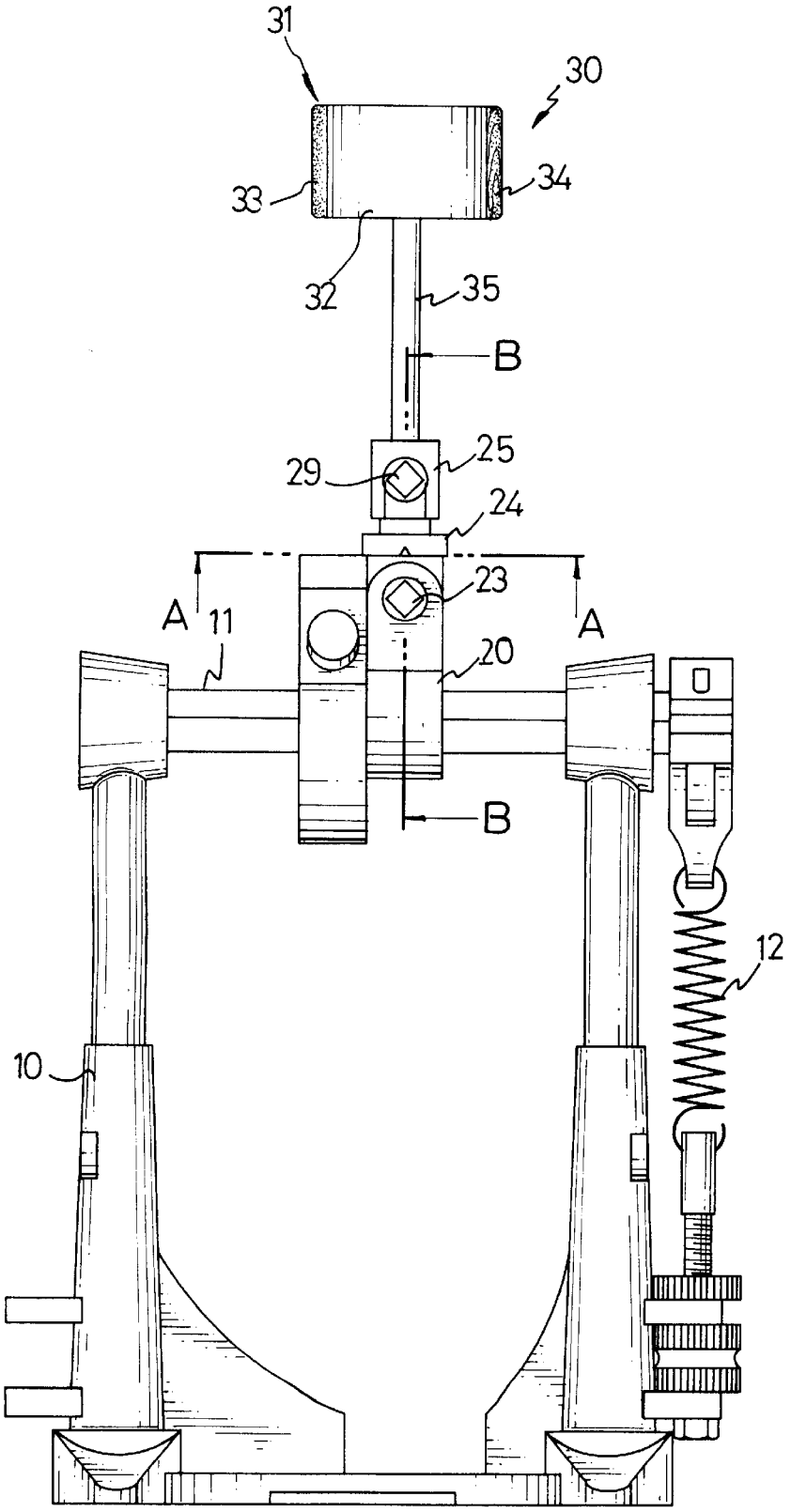
FIG. 3 is a front view showing the drum frame with the drumstick of a drum in accordance with the present invention.
Figure 5:
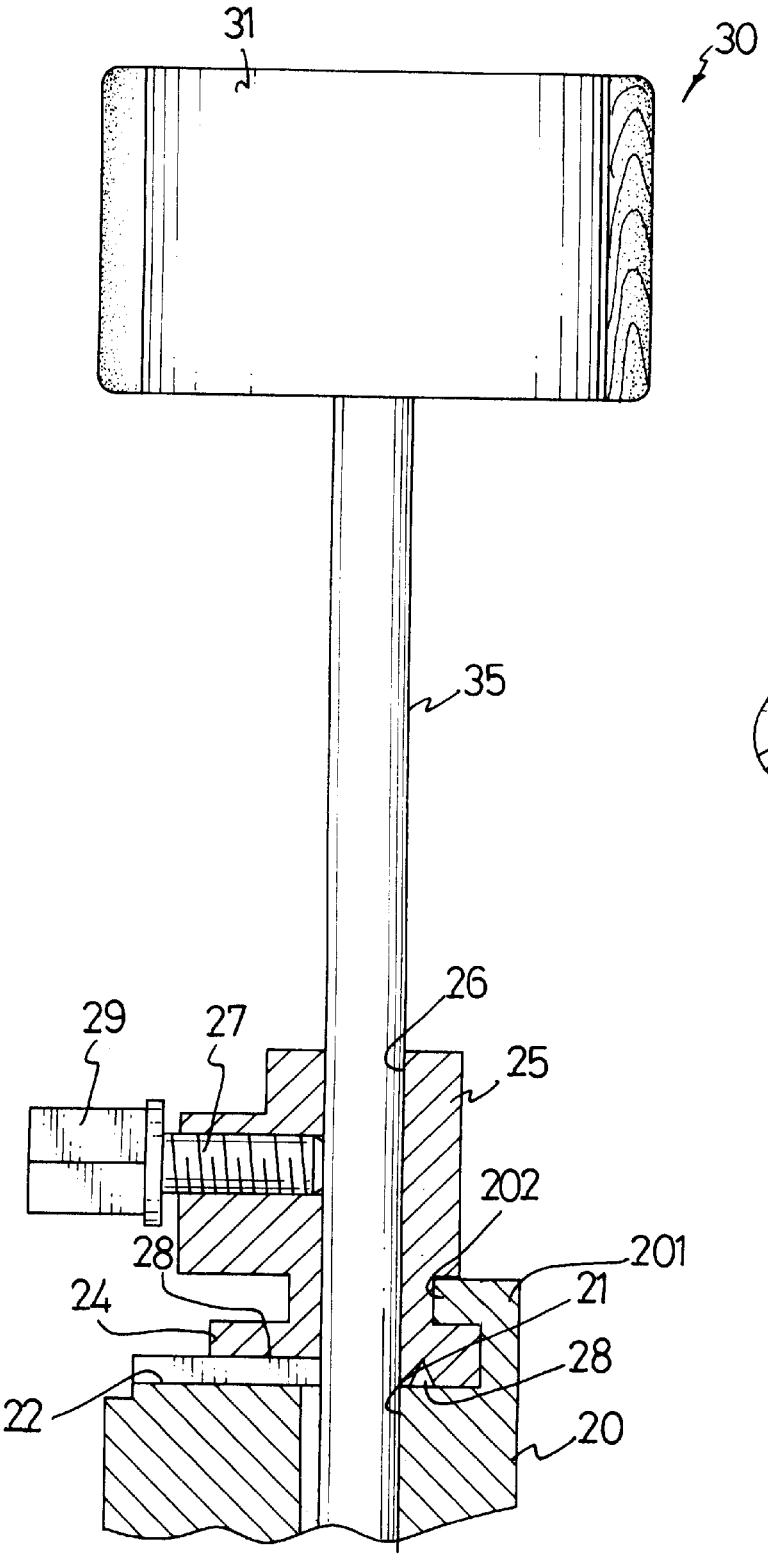
FIG. 5 is a schematic view of the line B—B taken from FIG. 3, showing the engagement between the rotator and a pedestal of the device of FIG. 2.
Figure 4:
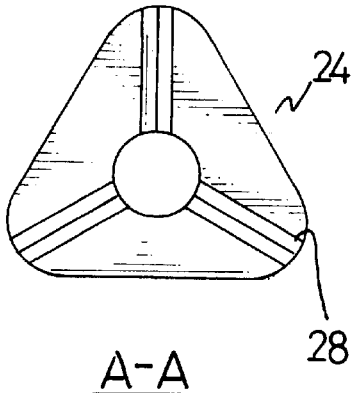
FIG. 4 is a schematic view of the line A—A taken from FIG. 3.
Figure 6:
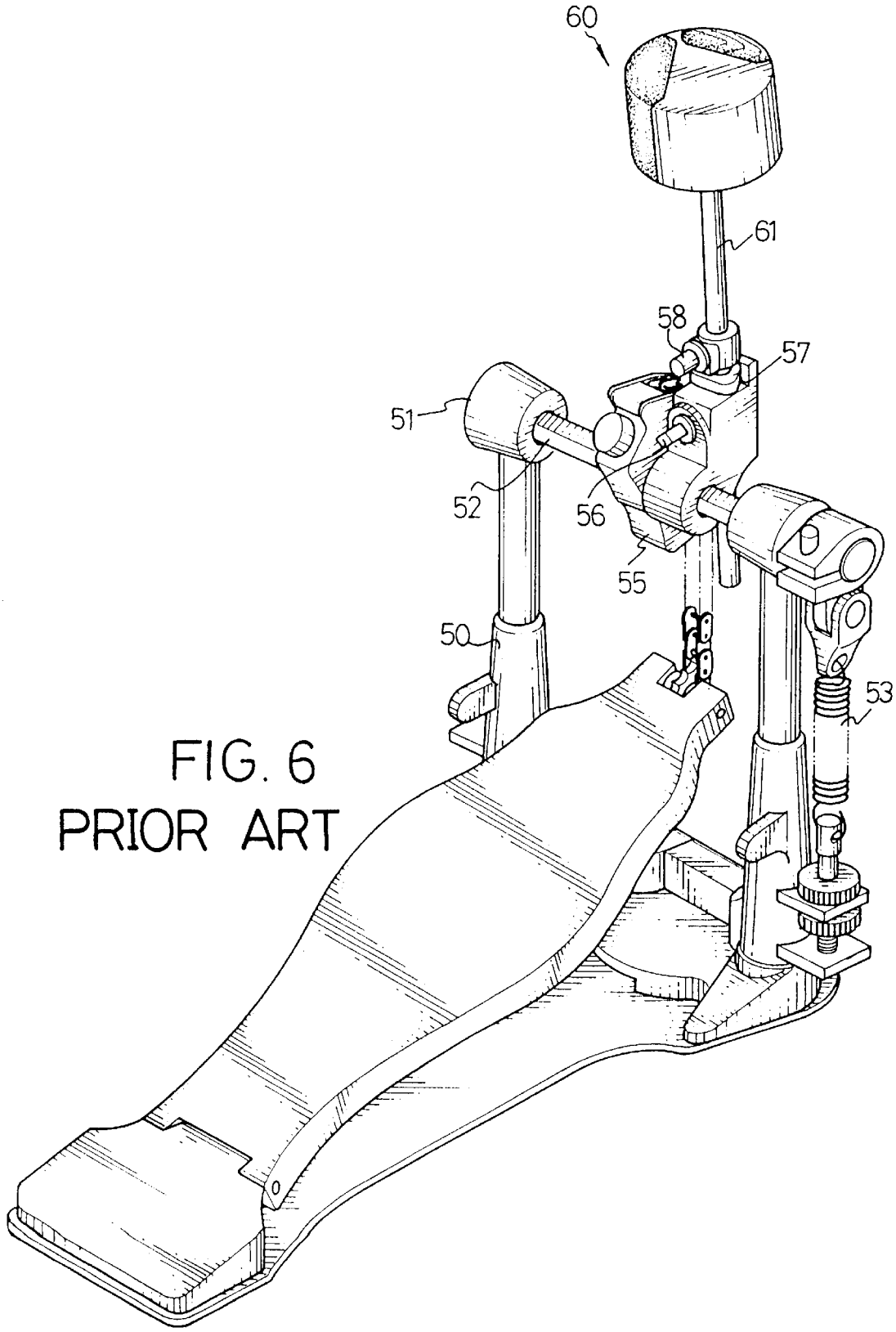
FIG. 6 PRIOR ART
FIG. 6 is a perspective view showing a conventional drum frame with a drumstick.

Referring to FIG. 2 and FIG. 3, the pedestal 20 of the securing device defines a first through hole 21 therein for the stem 35 of the drumstick 30 to extend therethrough. A first bolt 23 is screwed from one side of the pedestal 20 into the first through hole 21 to retain the extended stem 35. The pedestal 20 further has a protrusion 22 integrally extending from a surface thereof. The rotator 24 has a sleeve 25 integrally formed thereon. The sleeve 25 defines a second through hole 26 align with the first through hole 21 of the Pedestal 20 for the stem :35 to extend therethrough. The sleeve 25 also defines a screw hole 27 at a circumference thereof so that a second bolt 29 can be screwed into the second through hole 26 to retain the stem 35 of the drumstick 30. The rotator 24 further isometrically defines a 4 plurality of recesses 28 in a bottom surface thereof for respectively receiving the protrusion 22 of the pedestal 20. in this embodiment, the rotator 24 defines three recesses 28 respectively corresponding to the rubber part 32, the blanketing part 33 and the wood part 34 of the head 31 of the drumstick 30, as shown in FIG. 4. The pedestal 20 further forms a retainer 201 integrally at a side thereof. A height of the retainer 201 is the same as a thickness of the rotator 24. A hook 202 is integrally formed on a top of the retainer 201 to grip and secure the rotator 24 on the pedestal 20.

In assembly, the rotator 24 is firstly secured on the pedestal 20 by the hook 202 of the retainer 201. Then the stem 35 of the drumstick 30 is sequentially inserted into the second through hole 26 of the rotator 24 and the first through hole 21 of the pedestal 20, and the rubber part 32, the blanketing part 33 and the wood part 34 of the drumstick 30 are arranged to respectively correspond to the three recesses 28 of the rotator 24. Then the rotator 24 and the pedestal 20 can be engaged by the protrusion 22 of the pedestal 20 being received in one of the three recesses 28 of the rotator 24. Thereafter, the drumstick 30 can be secured on the rotator 24 by the second bolt 29, and further can be secured by the first bolt 23, as shown in FIG. 3.

Therefore, the drumstick 30 can be effectively located and generates a stable and harmony sound with respect to one material of the head 31.

When a different sound effect is required during performance, it can be accomplished by a user releasing the first bolt 23 and then rotating the rotator 24 to make a different recess 28 receive the protrusion 22 of the pedestal 20. Since each recess 28 is pre-arranged to correspond to each part of the drumstick head 31, it is easy to relocate the drumstick 30 accurately.

Accordingly, the present invention provides a device which can securely locate the drumstick 30 of a drum. With the engagement of the protrusion 22 of the pedestal 20 and the recess 28 of the rotator 24, vibration generated during the beat of the drumstick 30 can be effectively offset and even through the first and second bolt 23 are slightly loose during the performance, a rotation of the drumstick 30 still can be prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A device for securing and positioning a drumstick of a drum comprising:

a pedestal mounted on a pivot of the drum, said pedestal having a protrusion formed on a surface thereof;

a rotator movably engaged with the pedestal, said rotator defining a plurality of recesses at a bottom thereof to respectively receive the protrusion of the pedestal.

2. A device for securing a drumstick of a drum as claimed in claim 1, wherein said rotator isometrically defines three recesses at the bottom thereof, respectively corresponding to three materials wrapping the drumstick.

3. A device for securing a drumstick of a drum as claimed in claim 1, wherein said pedestal and said rotator respectively defines a first through hole and a second through hole aligned with each other for a stem of the drumstick to extending therethrough, and said pedestal and said rotator is further defines a first screw hole and a second screw hole respectively in which two bolts are threaded to retain the stem of the drumstick.

4. A device for securing a drumstick of a drum as claimed in claim 1, wherein said pedestal further forms a retainer at a side thereof, a height of the retainer being the same as a thickness of the rotator, a hook integrally formed on a top of the retainer to grip and secure the rotator on the pedestal.

* * * * *